US008640968B2

(12) United States Patent
Lin et al.

(10) Patent No.: US 8,640,968 B2
(45) Date of Patent: Feb. 4, 2014

(54) TEMPERATURE GAIN CONTROL DEVICE AND METHOD THEREOF

(75) Inventors: Tzu Cheng Lin, Taipei County (TW); Yu Kuang Lee, Taipei County (TW); Wei Cheng Chou, Taipei County (TW); Hsin Ju Wu, Taipei County (TW)

(73) Assignee: Moxa Inc., Taipei County (TW)

( * ) Notice: Subject to any disclaimer, the term of this patent is extended or adjusted under 35 U.S.C. 154(b) by 947 days.

(21) Appl. No.: 12/662,756

(22) Filed: May 3, 2010

(65) Prior Publication Data

US 2011/0266356 A1 Nov. 3, 2011

(51) Int. Cl.
*F24F 11/053* (2006.01)

(52) U.S. Cl.
USPC ..... 236/1 C; 219/209

(58) Field of Classification Search
USPC ..... 236/1 C; 237/2 A; 219/209, 210, 385, 219/481, 482, 487, 488, 490; 454/184; 700/299, 300
See application file for complete search history.

(56) References Cited

U.S. PATENT DOCUMENTS

2010/0044361 A1* 2/2010 Lin et al. ..... 219/209
2011/0073668 A1* 3/2011 Garber ..... 236/101 R

* cited by examiner

*Primary Examiner* — Cheryl J Tyler
*Assistant Examiner* — Jonathan Bradford
(74) *Attorney, Agent, or Firm* — Bacon & Thomas, PLLC

(57) ABSTRACT

This specification discloses a device of controlling temperature gain and the method thereof. The invention detects the temperature of work environment and uses it to generate a control signal and a PWM signal for dynamically controlling the heaters around electronic elements to heat up. When the temperature of work environment is too low, the invention can increase the stability of the electronic elements.

17 Claims, 5 Drawing Sheets

TEMPERATURE GAIN CONTROL DEVICE AND METHOD THEREOF

BACKGROUND OF THE INVENTION

1. Field of Invention

The invention relates to a control device and the method thereof In particular, the invention pertains to a control device that uses a heater to control the temperature gain of the work environment temperature of an electronic element and the method thereof.

2. Related Art

Due to their popularity, many electronic devices are used to operate in work environments with extreme temperatures. However, because of the difficult work environments, it is very common for the devices to fail or function abnormally. Therefore, how to enable the electronic devices to work normally under extreme temperatures has become an important issue for vendors.

Generally speaking, extreme temperatures of the work environments include overheating and overcooling. Since electronic elements generate heat as well, their lifetime will be greatly reduced if they are in an extreme hot environment or their failure rates go up. Currently, there are many solutions for overheating, such as air-cooling, water-cooling, etc. However, in an overcooled work environment, electronic elements cannot generate sufficient heat to maintain a desired work environment temperature. This may render the electronic elements not useable. For example, when a fluid dynamic bearing (FDB) hard disk drive (HDD) works under an overcooled temperature, the oil film in the FDB may not stay as a fluid. In this case, the FDB HDD will fail because the oil film cannot achieve its functions.

In view of this, some vendors propose to concentrate heat-generating elements around the electronic device that needs to work at a certain temperature through circuit layout designs. They even add more heating devices to heat up the electronic element. However, the temperature increase by the circuit layout design is very limited and involves many uncertainties. Adding more heating devices increases the cost of the electronic device or even difficulty in layout designs. Therefore, these methods cannot effectively solve the problem that electronic devices cannot function normally when the work environment temperature is too low.

In summary, the prior art always has the problem that electronic devices cannot function normally when the work environment temperature is too low. It is necessary to provide a better technique to solve this problem.

SUMMARY OF THE INVENTION

In view of the foregoing, the invention discloses a device of controlling temperature gain and the method thereof.

The disclosed device of controlling temperature gain used in a device with electronic elements includes: a sensing module, a BIOS module, a heating module, and a heater. The sensing module continuously detects the work environment temperature in the device, and compares the work environment temperature with a predetermined first temperature parameter. It then generates a control signal according to the comparison result. The BIOS module sets and stores a second temperature parameter. It continuously offsets the work environment temperature by an interval, and compares the offset work environment temperature with the second temperature parameter. The comparison result is used to select the control mode for driving a control chip to produce a corresponding pulse width modulation (PWM) signal. The heating module generates an output power according to the control signal. After the production of the PWM signal, the control signal and the PWM signal are combined to adjust the output power. The heater is disposed around the electronic elements to receive the output power. It uses the output power to heat up the electronic elements.

The work environment temperature is compared with the first temperature parameter by a comparator. The comparator setting the control signal to "ON" when the work environment temperature is no higher than the first temperature parameter, as well as the comparator setting the control signal to "OFF" when the work environment temperature is higher than the first temperature parameter. A second control signal can be set by the Basic Input/Output System (BIOS) and stored in volatile memory. The control mode includes temperature ranges, each of which has a corresponding PWM signal. The interval is used to maintain the work environment temperature at a positive temperature. The control chip is a Super I/O chip. The heater can be a soft heating plate. Besides, the sensing module includes at least a temperature parameter recorder, a temperature sensor, and a comparator. The BIOS module includes at least a memory unit, a BIOS unit, and a control chip. The heating module includes at least a temperature control switch, a PWM control switch, and a power control switch.

The disclosed method of controlling temperature gain is used in a device with electronic elements and a heater. The method includes the steps of: continuously detecting the work environment temperature of the device and comparing the work environment temperature with a predetermined temperature parameter, thereby generating a control signal; setting and storing a second temperature parameter, continuously offsetting the work environment temperature by an interval and comparing the offset work environment temperature with the second temperature parameter, and selecting a control mode according to the comparison result to drive a control chip to generate a corresponding PWM signal; generating an output power according to the control signal and adjusting the output power according to the combination of the control signal and the PWM signal after the PWM signal is generated; disposing the heater around the electronic elements for receiving the output power and using the output power to heat up the electronic elements.

The difference between the disclosed device and method and the prior art is in that the invention detects the work environment temperature and generates a control signal and a PWM signal according to the detected work environment temperature. Thus, the invention can dynamically control the heater disposed around the electronic elements for heating.

Using the disclosed technique, the invention can achieve the goal of stabilizing electronic elements when their work environment temperature is too low.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Before elucidating the disclosed device and method of controlling temperature gain, we first define the application environment of the invention. The invention is used in a device with multiple electronic elements to maintain the work environment temperature thereof so that they do not function abnormally because the temperature is too low. In practice, the heater is used with a fan control mechanism of the device with the electronic elements to control the heating process.

The terms used in this specification are defined as follows. The first temperature parameter referred herein is a temperature reference point predetermined by the vendor of the electronic device. The first temperature parameter can be stored in nonvolatile memory, such as flash, EPROM, EEPROM, etc. In practice, the first temperature parameter is used to ensure that the work environment temperature can be maintained within an appropriate range before the electronic device starts (when it is on). For example, suppose the first temperature parameter is set as "0° C.; 20° C." When the temperature sensor detects that the work environment temperature is equal to or lower than "0° C.", the heater is controlled to heat up in order to increase the work environment temperature. When the work environment temperature is greater than "20° C.", the heater is controlled to stop heating in order for the electronic elements in the electronic device to operate normally in an appropriate temperature range. Besides, the second temperature parameter is a parameter set via the operating interface of the BIOS. It is used to ensure that the work environment temperature is within the appropriate range when the electronic device is functioning. The second temperature parameter and the first temperature parameter differ in that the first temperature parameter is used before and immediately after the electronic device starts and the second temperature parameter is used when the electronic device has started a while. Moreover, the first temperature parameter is set by the vendor before the electronic device is sold, while the second temperature parameter is set by the user via the BIOS.

Figure 1:
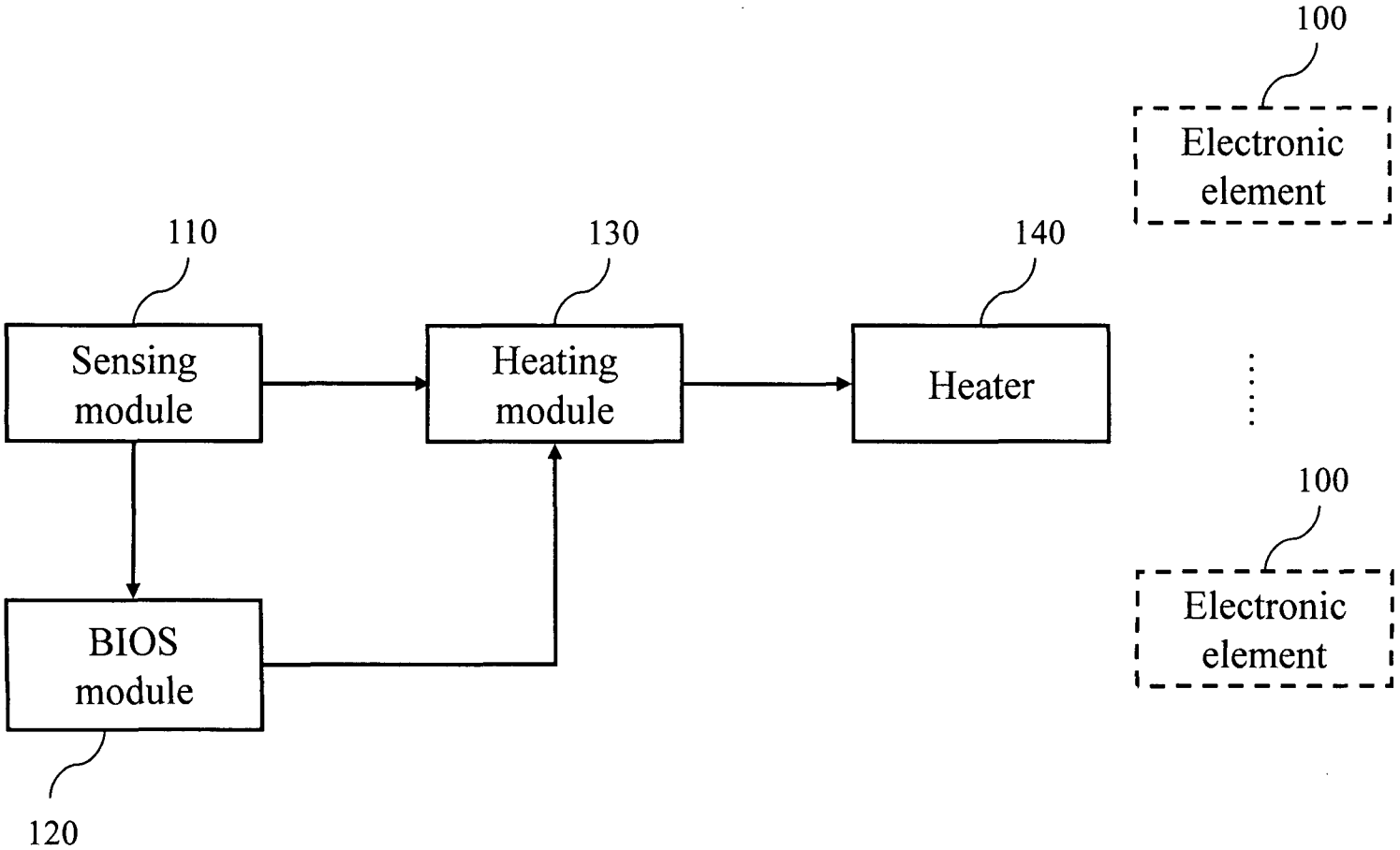
FIG. 1 is a block diagram of the disclosed temperature gain control device.

The invention is further described with reference to the accompanying figures. We first describe the disclosed device of controlling temperature gain. Please refer to FIG. 1, which is a block diagram of the device of controlling temperature gain according to the invention. It includes: a sensing module 110, a BIOS module 120, a heating module 130, and a heater 140. The sensing module 110 continuously detects the work environment temperature in the device, compares the detected work environment temperature with a predetermined first temperature parameter, and generates a control signal according to the comparison result. In practice, the sensing module 110 can be a temperature sensor, such as thermal resistor, temperature sensing IC (AD 590), etc, that detects the work environment temperature. Since using a temperature sensor to obtain the work environment temperature belongs to the prior art, it is not further described herein. After the sensing module 110 detects the work environment temperature, the comparator is used to compare the work environment temperature with the first temperature parameter. When the work environment temperature is no higher than the first temperature parameter, it generates the control signal of "ON". When the work environment temperature is higher than the first temperature parameter, it generates the control signal of "OFF".

The BIOS module 120 enables the user to set and store a second temperature parameter. It further continuously offsets the work environment temperature detected by the sensing module 110 by an interval, compares the offset work environment temperature with the second temperature parameter, and selects a control mode according to the comparison result. The control mode is then used to drive a control chip to generate a pulse width modulation (PWM) signal. The PWM signal belongs to the prior art and is not further described herein. In practice, the user sets the second temperature parameter via the BIOS operating interface. The BIOS is stored in nonvolatile memory, such as flash, EPROM, EEPROM, etc. The second temperature parameter is stored in volatile memory, such as CMOS RAM. Moreover, the control mode refers to the correspondence relation between different second temperature parameters and PWM signals. For example, the control mode may include more than one situation. The first situation is: when the second temperature parameter is "10° C.", generate the PWM signal "40%" (PWM duty cycle); the second situation is: when the second temperature parameter is "30° C.", generate the PWM signal "20%"; and so on. It should be emphasized that the invention is not restricted to the above example.

After the BIOS module 120 selects a control mode according to the comparison result, the control chip is driven to generate a corresponding PWM signal. The control chip is a super I/O chip that has the PWM signal control mechanism, such as the W83627EHF chip. Since this control chip belongs to the prior art, it is not further described herein. It should be mentioned that the invention uses the smart fan control of this conventional control chip to control the heater. However, the smart fan control function does not support work environment temperatures below 0° C. Therefore, the BIOS module 120 offsets the work environment temperature detected by the sensing module 110 by an interval (e.g., the value "128"), so that the work environment temperature is kept positive (e.g., "0° C." or "above 0° C."), before the smart fan control function is used. For example, suppose the work environment temperature range that the sensing module 110 can detect is between "−128° C." and "127° C.". The corresponding addresses are 8-bit binary codes, ranging from "1000,0000" to "0111,1111". Since the smart fan control function cannot accurately process negative binary codes, the BIOS module 120 can offset "1000,0000" as "0000,0000", "1000,0001" as "0000,0001", and "0111,1111" as "1111,1111". In other words, the binary codes representing negative numbers are converted into binary codes that only represent positive numbers (for example, the addresses "−128~427" are converted into "0~255").

As a result, the smart fan control function of the control chip can generate the PWM signal accordingly. For example, suppose the work environment temperature is "−128° C.". After the above-mentioned offsetting, one obtains the binary code "0000,0000". Afterwards, a formula is employed to compute the corresponding PWM signal. The formula can be "the 8-bit binary code/255*100% and then inverted in value". In this example, the work environment temperature is "−128° C.". After the offset, its decimal value is "0". This value is inserted into the above formula to first obtain the value "0%" (i.e., "0/255*100%=0%"). This value "0%" is inverted to obtain the PWM signal of "100%". It should be emphasized that invention is not restricted by the above-mentioned formula.

The heating module 130 generates an output power according to the control signal. After the generation of the PWM signal, the control signal generated by the sensing module 110 and the PWM signal generated by the BIOS module 120 are combined to adjust the output power. In practice, suppose only the control signal is generated. The heating module 130 generates a corresponding output power according to the control signal. For example, a "0%" output power is produced when the control signal is "OFF"; a "100%" output power is produced when the control signal is "ON". Now suppose the BIOS module 120 has generated the PWM signal. If the control signal is "ON" and the PWM signal is "100%", then the heating module 130 simultaneously uses the control signal and the PWM signal to adjust its output power, e.g. "100%". If the control signal is "ON" and the PWM signal is "50%", then the heating module 130 adjusts to a "50%" output power. It should be noted that if the control signal is "OFF", then the heating module 130 adjusts to the minimal output power (e.g., "0%") or even turns off the heater 140 no matter whether the PWM signal is "0%". As a result, even if the BIOS module 120 is out of order and produces an abnormal PWM signal, the heater 140 does not continuously produce heat and damage the electronic elements 100.

The heater 140 is disposed around the electronic elements 100. It receives the output power produced by the heating module 130, and uses the output power to heat up the electronic elements 100. The heater can be a soft heating plate. Such a soft heating plate is disposed around the electronic elements 100 in the electronic device for increasing their work environment temperature. Since the heater 140 belongs to the prior art, it is not further described herein. It should be emphasized, however, that the invention does not restrict the number and types of the heaters 140.

Figure 2:
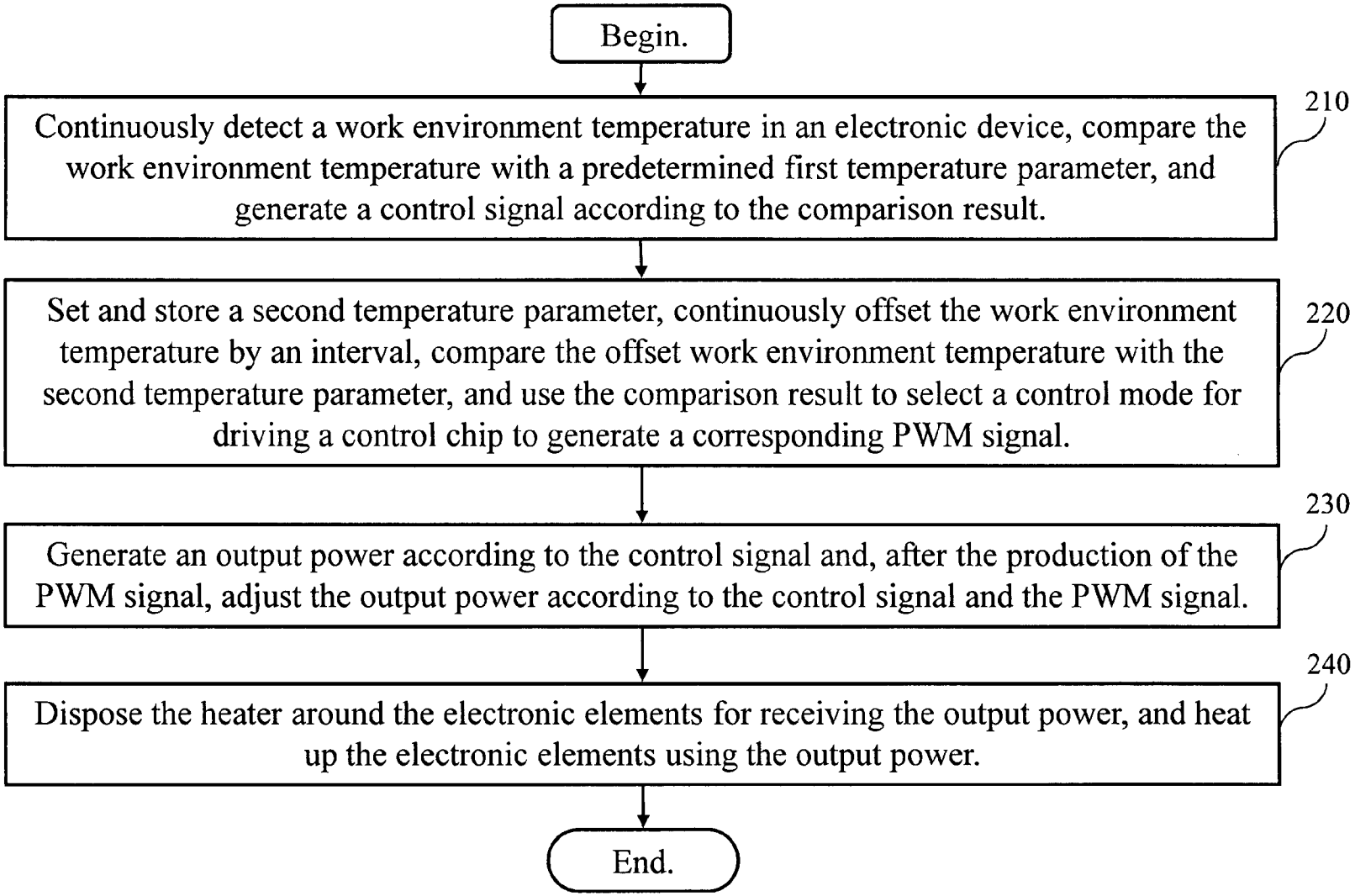
FIG. 2 is a flowchart of the disclosed method of controlling temperature gain.

FIG. 2 is a flowchart of the disclosed method of controlling the temperature gain. The method according to the invention includes the following steps. In step 210, the work environment temperature in the device is continuously monitored. The work environment temperature is compared with a predetermined first temperature parameter. A control signal is generated according to the comparison result. In step 220, a second temperature parameter is set and stored. The work environment temperature is continuously offset by an interval. The offset work environment temperature is compared with the second temperature parameter. The comparison result is used to select a control mode in order to drive the control chip to generate a corresponding PWM signal. In step 230, an output power is generated according to the control signal. After the PWM signal is generated, the control signal and the PWM signal are used to adjust the output power. In step 240, with a heater disposed around the electronic elements 100 to receive the output power, the output power is used to heat up the electronic elements 100. Through the above-mentioned steps, the invention can monitor the work environment temperature and generates the control signal and the PWM signal accordingly. The invention thus dynamically controls the heater disposed around the electronic elements 100.

Figure 3:
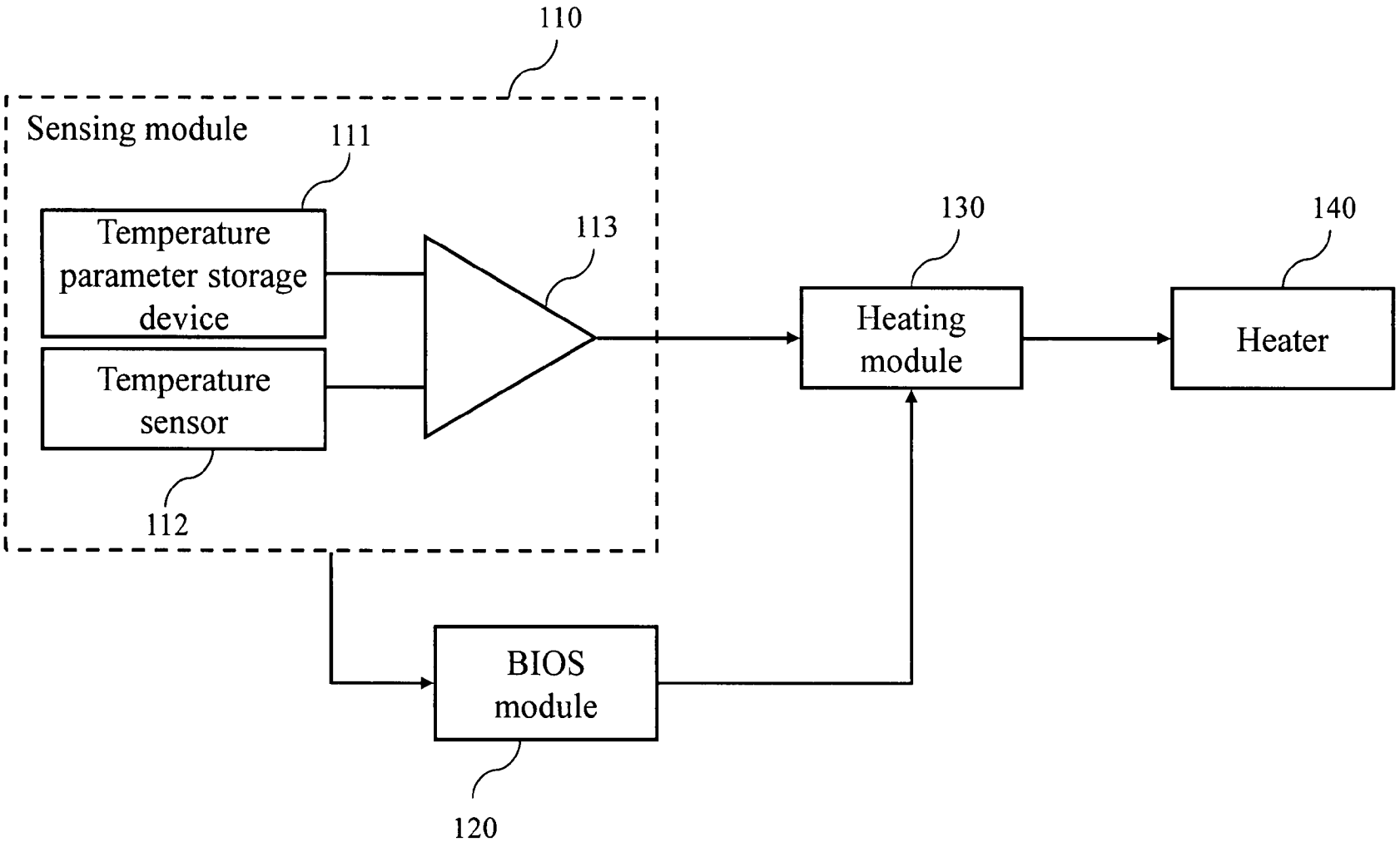
FIG. 3 is a schematic view of the sensing module according to the invention.
Figure 4:
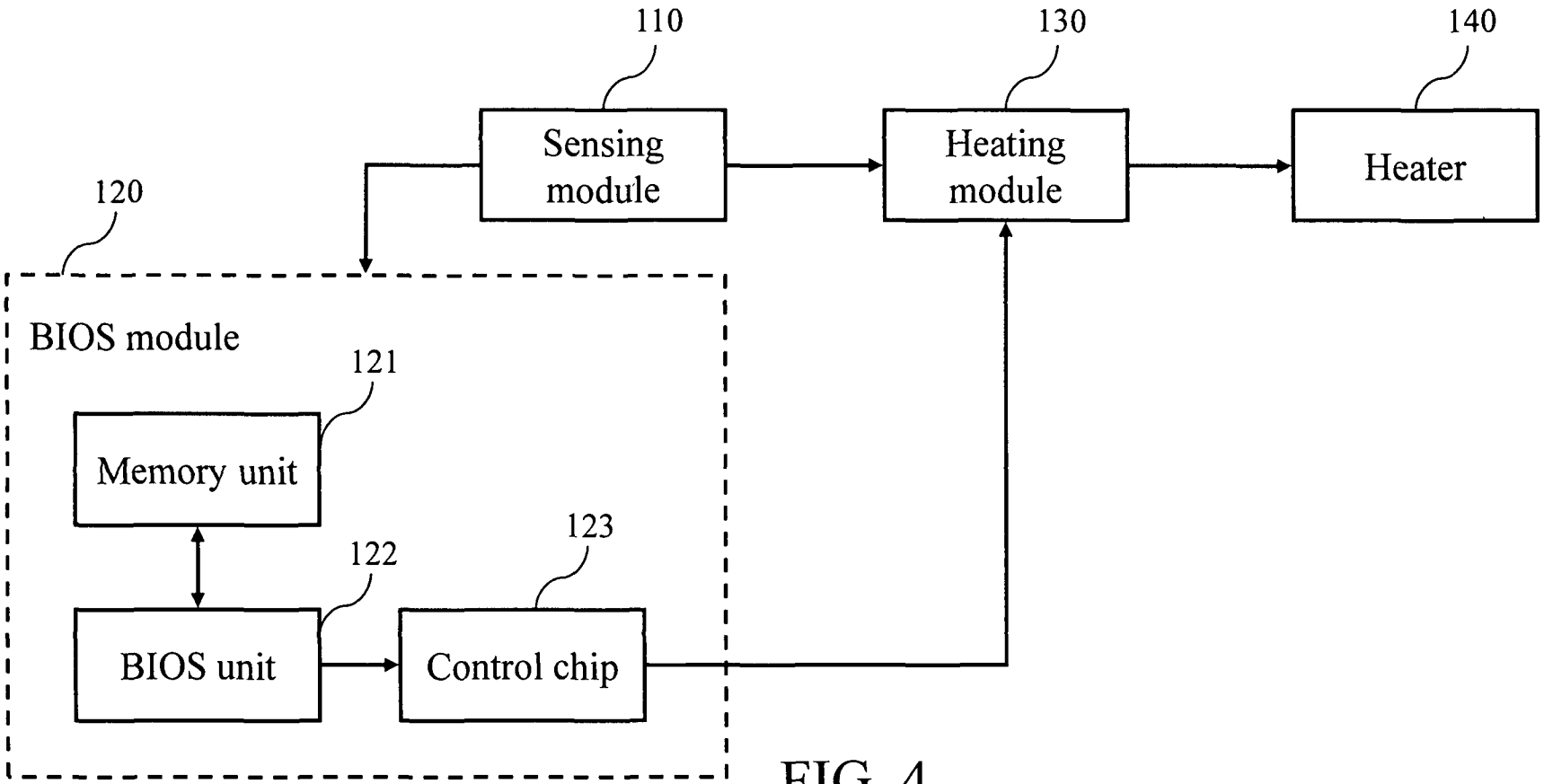
FIG. 4 is a schematic view of the BIOS module according to the invention.
Figure 5:
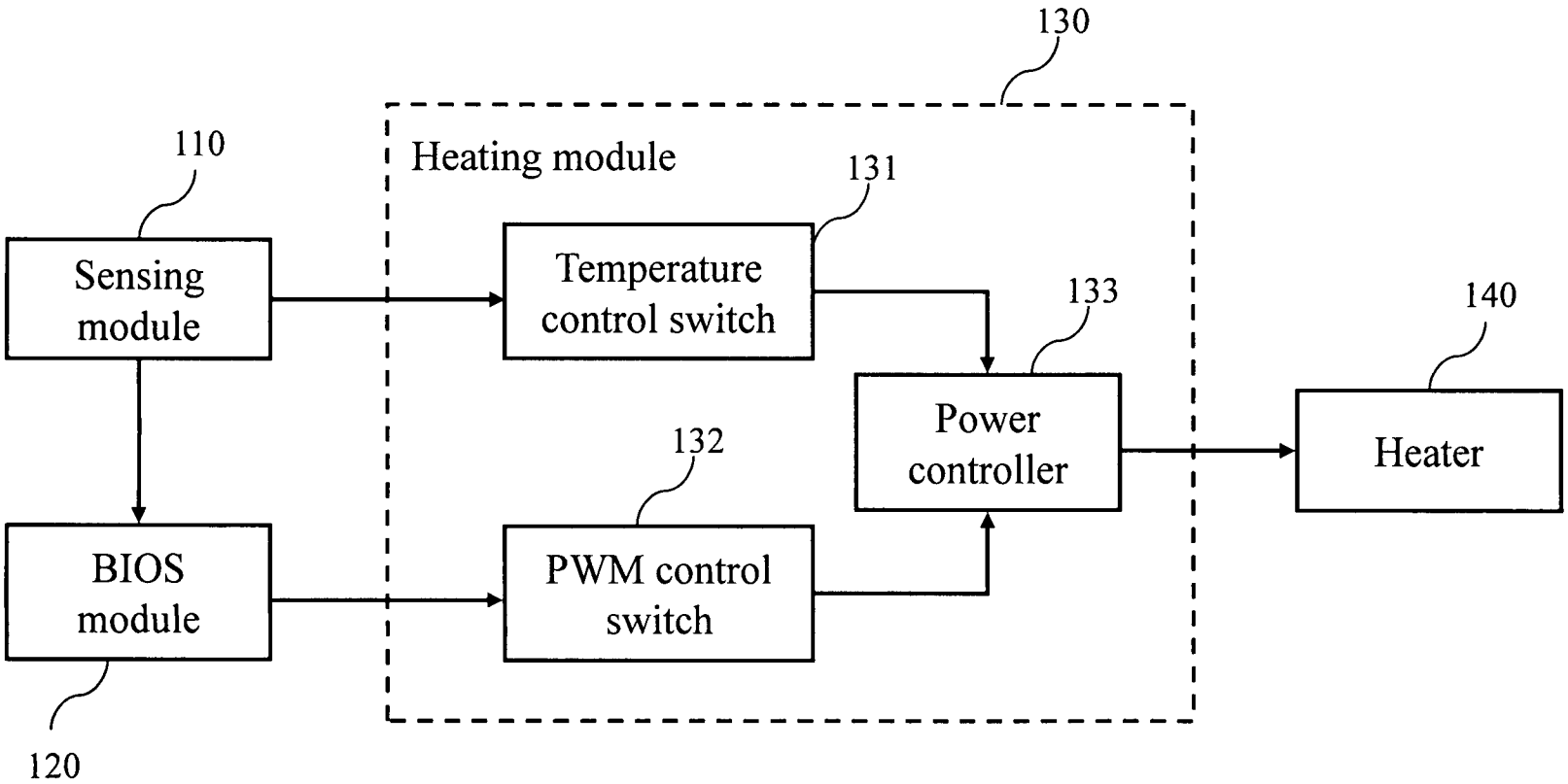
FIG. 5 is a schematic view of the heating module according to the invention.

Please refer to FIGS. 3 to 5 for an embodiment of the invention. FIG. 3 is a schematic view of the disclosed sensing module 110. It includes: a temperature parameter storage device 111, a temperature sensor 112, and a comparator 113. It should be noted that the invention is not limited to the scheme of using the sensing module 100 to generate the control signal via the comparator 113. Neither does the invention restrict the number and types of electronic elements 100 contained therein.

When the electronic device is on but not operating, or is operating normally, the temperature sensor 112 continuously monitors the work environment temperature. The comparator 113 compares the work environment temperature with the first temperature parameter previously stored in the temperature parameter storage device 111. The sensing module 110 generates the control signal according to the comparison result. Suppose the first temperature parameter is set as "0° C.; 20° C." It means that the control signal "ON" is generated when the work environment temperature is below "0° C.", and the control signal "OFF" is generated when the work environment temperature is above "20° C."

When the heating module 130 receives the control signal "ON", an output power is generated to turn on the heater 140. During the heating process, the work environment temperature detected by the temperature sensor 112 continuously rises. When the work environment temperature reaches above "20° C.", the sensing module 110 generates the control signal "OFF". In this case, the heating module 130 reduces its output power or even sets it as "0", so that the heater 140 reduces its heat output or even stops heating.

Please refer to FIG. 4, which is a schematic view of the disclosed BIOS module. The BIOS module 120 includes: a memory unit 121, a BIOS unit 122, and a control chip 123. The memory unit 121 stores the second temperature parameter. It can be volatile memory, such as CMOS RAM. In practice, the memory unit 121 also stores other BIOS-related setting parameters in addition to the second temperature parameter.

The BIOS unit 122 stores the BIOS of the electronic device and provides an operating interface for the user to perform related settings, such as the second temperature parameter. Since the BIOS belongs to the prior art, it is not further described herein. We only address the distinctive parts. The invention adds an offset calculation to the BIOS for calculating the offset from the binary temperature value detected by the temperature sensor 112 and inversing the calculated value. The final value is suitable for the Smart Fan Control of the control chip 123. The control chip 123 is then able to generate a suitable PWM signal. The heating module 130 controls the heater 140 according to the PWM signal. In practice, the control chip 123 can be the W83627EHF Super I/O chip. The temperature sensor 112 has an electrical contact with one of the "AUXTIN", "CPUTIN", and "SYSTIN" pins (e.g., pin 102, pin 103, and pin 104) of the control chip 123. The heating module 130 has an electrical contact with one of the "AUXFANOUT", "CPUFANOUT0,1", and "SYSFANOUT" pins (e.g., pin 7, pin 115/pin 120, and pin 116) of the control chip 123. In other words, there can be at most three sets of the temperature sensor 112 and the heater 140 at the same time. Take the case of three sets as an example. The control chip 123 can use the three work environment temperatures detected by the three sets of temperature sensors 112 to produce three corresponding PWM signals using the same method. The PWM signals are then used to control the corresponding heaters 140.

FIG. 5 is a schematic view of the disclosed heating module. In practice, the heating module 130 includes: a temperature control switch 131, a PWM control switch 132, and a power controller 133. The heating module 130 receives the control signal transmitted from the sensing module 110 via the temperature control switch 131. It receives the PWM signal transmitted from the BIOS module 120 via the PWM control switch 132. It then generates an output power according to the control signal via the power controller 133. After the PWM signal is generated, both the control signal and the PWM signal are used to adjust the output power, so that the heater 140 heats up according to the output power generated before the production of the PWM signal or according to the adjusted output power generated after the production of the PWM signal. It should be noted that even though the heater 140 of the invention heats up or stops heating according to the control signal and the PWM signal, the primary difference between the control signal and the PWM is that the control signal has a variable voltage and the PWM signal has a fixed voltage.

In summary, the invention differs from the prior art in that it detects the work environment temperature and generates the control signal and the PWM signal accordingly. The signals are used to dynamically control the heater disposed around the electronic elements 100. This technique can solve the problems existing in the prior art. The invention can increase the stability of the electronic elements 100 when the work environment temperature is too low.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A temperature gain control device used in an electronic device with a plurality of electronic elements, comprising:

a sensing module, which continuously detects a work environment temperature in the device, compares the work environment temperature with a predetermined first temperature parameter, and generates a control signal according to the comparison result;

a BIOS module, which enables the setting and storage of a second temperature parameter, continuously offsets the work environment temperature by an interval, compares the offset work environment temperature with the second temperature parameter, and uses the comparison result to select a control mode for driving a control chip to generate a corresponding pulse width modulation (PWM) signal;

a heating module, which generates a output power according to the control signal and, after the production of the PWM signal, adjusts its output power according to the control signal and the PWM signal; and at least one heater, which is disposed around the electronic elements for receiving the output power and heating up the electronic elements using the output power.

2. The temperature gain control device of claim 1, wherein the work environment temperature is compared with the first temperature parameter by a comparator, wherein:

the comparator setting the control signal to "ON" when the work environment temperature is no higher than the first temperature parameter; and the comparator setting the control signal to "OFF" when the work environment temperature is higher than the first temperature parameter.

3. The temperature gain control device of claim 1, wherein the second control signal is set by the basic input/output system (BIOS) and stored in volatile memory.

4. The temperature gain control device of claim 1, wherein the control mode includes at least one temperature range, each temperature in the range having a corresponding PWM signal.

5. The temperature gain control device of claim 1, wherein the interval is a numerical value that keeps the work environment temperature positive.

6. The temperature gain control device of claim 1, wherein the control chip is a Super I/O chip.

7. The temperature gain control device of claim 1, wherein the heater is a soft heating plate.

8. The temperature gain control device of claim 1, wherein the sensing module includes at least a temperature parameter storage device, a temperature sensor, and a comparator.

9. The temperature gain control device of claim 1, wherein the BIOS module includes at least a memory unit, a BIOS unit, and a control chip.

10. The temperature gain control device of claim 1, wherein the heating module includes at least a temperature control switch, a PWM control switch, and a power control switch.

11. A method of controlling temperature gain used in an electronic device with a plurality of electronic elements and at least one heater, comprising the steps of:

continuously detecting a work environment temperature in the electronic device, comparing the work environment temperature with a predetermined first temperature parameter, and generating a control signal according to the comparison result;

setting and storing a second temperature parameter, continuously offsetting the work environment temperature by an interval, comparing the offset work environment temperature with the second temperature parameter, and using the comparison result to select a control mode for driving a control chip to generate a corresponding PWM signal;

generating an output power according to the control signal and, after the production of the PWM signal, adjusting the output power according to the control signal and the PWM signal; and disposing the heater around the electronic elements for receiving the output power and heating up the electronic elements using the output power.

12. The method of claim 11, wherein the work environment temperature is compared with the first temperature parameter by a comparator, wherein:

the comparator setting the control signal to "ON" when the work environment temperature is no higher than the first temperature parameter; and the comparator setting the control signal to "OFF" when the work environment temperature is higher than the first temperature parameter.

13. The method of claim 11, wherein the second control signal is set by the BIOS and stored in volatile memory.

14. The method of claim 11, wherein the control mode includes at least one temperature range, each temperature in the range having has a corresponding PWM signal.

15. The method of claim 11, wherein the interval is a numerical value that keeps the work environment temperature positive.

16. The method of claim 11, wherein the control chip is a Super I/O chip.

17. The method of claim 11, wherein the heater is a soft heating plate.

* * * * *